United States Patent [19]

Gorski et al.

[11] 4,355,522

[45] Oct. 26, 1982

[54] PASSIVE ICE FREEZING-RELEASING HEAT PIPE

[75] Inventors: Anthony J. Gorski, Lemont; William W. Schertz, Batavia, both of Ill.

[73] Assignee: The United States of America as represented by the United States Department of Energy, Washington, D.C.

[21] Appl. No.: 191,611

[22] Filed: Sep. 29, 1980

[51] Int. Cl.[3] ..... F25C 1/00

[52] U.S. Cl. ..... 62/340; 165/12; 165/45; 165/104.21

[58] Field of Search ..... 165/104.21, 12, 45; 62/340

[56] References Cited

U.S. PATENT DOCUMENTS

| | | | |
|---|---|---|---|
| 3,914,957 | 10/1975 | Jacobs | 165/104.21 X |
| 4,003,214 | 1/1977 | Schumacher | 62/340 |
| 4,223,819 | 11/1980 | Stottman | 165/104.21 X |
| 4,261,417 | 4/1981 | Tingley | 165/104.21 X |
| 4,271,681 | 6/1981 | Schertz | 62/260 |

*Primary Examiner*—J. William E. Tapolcai

*Attorney, Agent, or Firm*—Paul A. Gottlieb; Richard G. Besha; James E. Denny

[57] ABSTRACT

A heat pipe device has been developed which permits completely passive ice formation and periodic release of ice without requiring the ambient temperature to rise above the melting point of water. This passive design enables the maximum amount of cooling capacity to be stored in the tank.

15 Claims, 4 Drawing Figures

PASSIVE ICE FREEZING-RELEASING HEAT PIPE

CONTRACTUAL ORIGIN OF THE INVENTION

The United States Government has rights in this invention pursuant to Contract No. W-31-109-ENG-38 between the U.S. Department of Energy and Argonne National Laboratory.

BACKGROUND OF THE INVENTION

The development of technology to store energy for cooling in summer through ice formation during winter time has taken on increased significance in this age of increasing energy shortages and costs. In the United States, the Annual Cycle Energy System (ACES) program has demonstrated the capability to generate and store ice during the winter season. In the ACES program, ice is formed as a by-product of the waste product cooling capacity of a residential heat pump used to heat a residence. The ACES program is set forth in detail in: *ACES Demonstration: Construction, Start-up, and Performance Report,* Oak Ridge National Laboratory, ORNL/CON-26 (October 1978), by A. S. Holman and V. R. Brantley. This type of system is an active one requiring valves, pumps, and sensors for operation.

Passive systems have also been developed with the main incentive being reduction of capital expenses and maintenance costs, and more effective formation and storage of ice. One example of a passive ice formation system is described in a pending application (Ser. No. 37,078, "Long Term Ice Storage for Cooling Applications," by William W. Schertz). Another example is a device developed by Advance Cooler, Inc., Clifton, N.Y. In this device, the heat pipe extends into the water tank with the heat pipe making a right angle bend and continuing in a horizontal manner with rib-like cooling appendages branching off the main pipe. However, this design does not permit release of any substantial portion of the ice formed about the heat pipe structure in the water.

The inventors herein have deduced that the maximum volume of ice will be formed if ice is frozen in smaller volumes and undergoes release from the freezing surfaces. If ice is allowed to freeze in large volumes over or about the freezing surfaces, the rate of ice formation is impeded by the low thermal conductivity of the thick ice layers. As a result, smaller total volumes of ice are formed over a given time period, and less cooling capacity is stored. Consequently, the means to store the maximum amount of cooling energy is by ice formation of relatively small volumes and subsequent release. The periodic formation and release of small ice volumes has been accomplished, as shown in U.S. Pat. No. 4,003,214, but this invention utilizes an active means to attain this result.

A variety of ways to accomplish formation and effective release of small ice volumes by passive freeze-release techniques have been discussed by A. Gorski, W. Schertz, R. Rush, A. Wantroba, and R. Cole, in "Long Term Ice Storage for Cooling Applications Using Passive Freezing Techniques," 4th National Passive Solar Conference, Oct. 3–5, 1979. However, prior to the invention disclosure herein, methods of passive freeze-release ice formation relied on the ambient temperature being above 0° C. for some time period in order to function effectively in the passive release mode.

It is therefore an object of the invention to provide a device for passive ice formation and reliable release of ice from freezing surfaces in a storage tank.

It is also an object of the invention to provide a device having passive structural features which promote periodic release of ice formed in a storage tank.

It is a further object of the invention to provide a device having an internal heat pipe and receptacles internal to the main heat pipe which act to promote periodic release of ice formed.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The invention provides a device which is able to freeze and periodically release ice for storage of coolness in a tank. This may be accomplished in a reliable fashion without requiring the ambient temperature to rise above 0° C., and is carried out by a passive means without any need for valves, pumps, or other mechanical devices. The device includes a main heat pipe within which is: an internal heat pipe to promote reliable release of ice and an on-off timer structural system which periodically attenuates the normal working cycle of the main heat pipe to allow the internal heat pipe to effect release of ice formed on the main heat pipe exterior.

DETAILED DESCRIPTION OF THE PREFERRED EMBODIMENT

Figure 1:
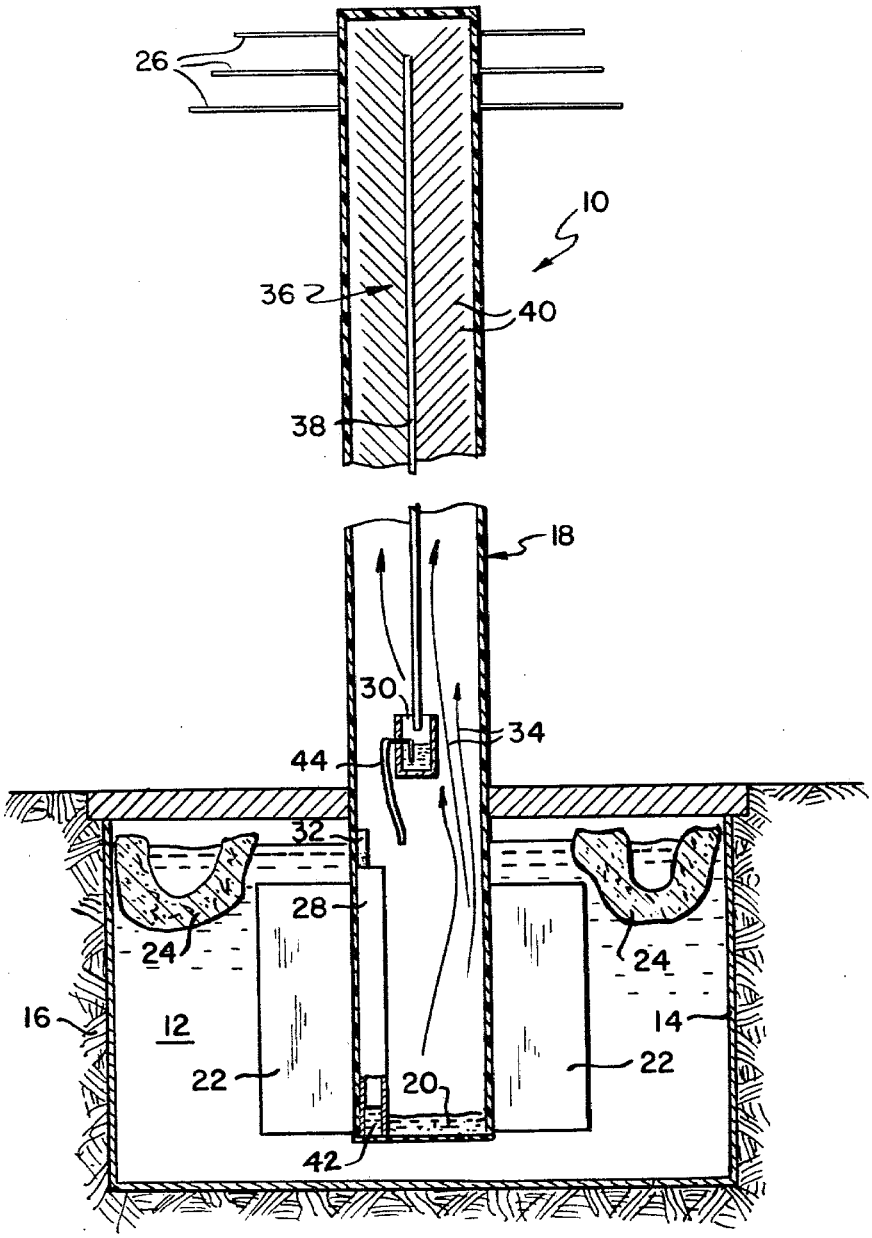
FIG. 1 illustrates an ice formation and storage system with a heat pipe design able to effect completely passive ice-freezing and release.
Figure 2:
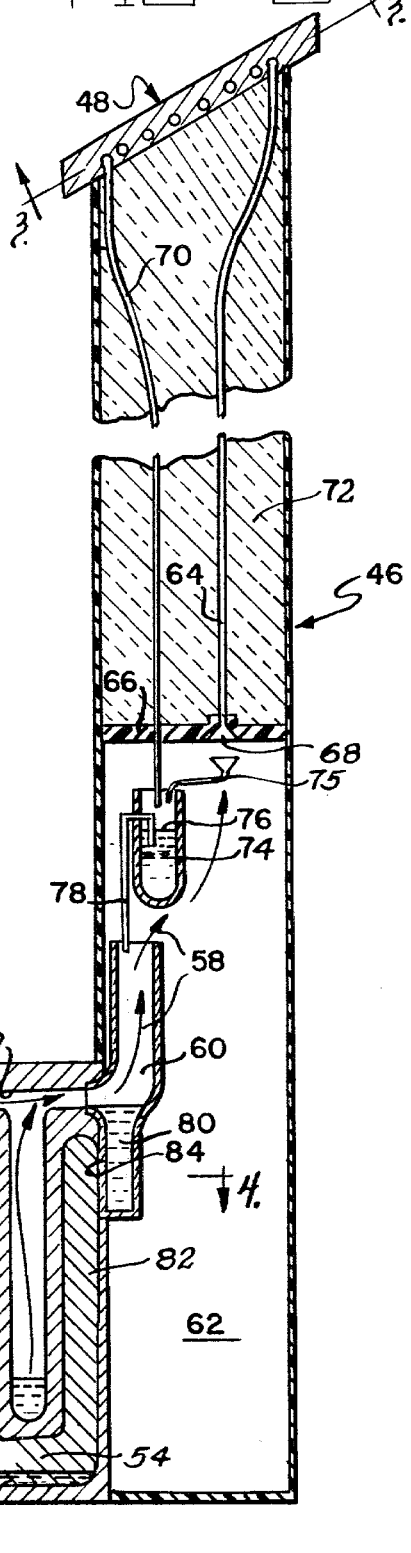
FIG. 2 shows an alternative embodiment of the device of FIG. 1.

FIGS. 1 and 2 illustrate alternative configurations for the preferred embodiment of the invention. FIG. 1 represents one structural version for effectuating completely passive ice formation and periodic release. In FIG. 1, the lower part of heat pipe assembly 10 is immersed in solution 12 (typically water) contained within tank 14, which is buried in ground 16. Alternatively, tank 14 may be surrounded by some effective form of insulation to prevent loss of cooling capacity when needed during the summer months. Heat pipe assembly 10 includes heat pipe 18 with a suitable heat pipe fluid 20 sealed within heat pipe 18. A typical fluid is a low boiling point fluid such as ammonia or a fluorcarbon.

Generically, a heat pipe operates by the heat pipe fluid removing heat from the warmer, bottom section of the heat pipe through boiling of the fluid. The fluid vapors travel upward and condense in the cooler above ground section, thereby releasing heat to the ambient atmosphere during the winter period. Upon releasing heat to the ambient, the vapors condense and return by gravity to the lower section of the heat pipe to complete the cycle. This process then allows reduction of the temperature in the lower, submerged section of the heat pipe, thereby allowing formation of ice from the water surrounding the submerged section of a heat pipe. The vast majority of heat flow is therefore from the submerged lower section of a heat pipe to the upper section positioned in the ambient. The only mechanism for heat transfer from the ambient to the submerged section is by conduction down the heat pipe walls. Thus, a thermal diode effect is produced by the heat pipe.

The structure of FIG. 1 is configured to produce completely passive ice formation and to insure the periodic release of ice formed. Attached to the exterior of heat pipe 18 are freezing fins 22, which act to improve heat exchange and prevent ice from completely encapsulating heat pipe 18. Thus, ice 24 is more readily formed between fins 22 and is more easily released from the freezing surfaces of heat pipe 18. Fins 22 do not extend above the surface of the water in tank 14 since fins 22 would act as an obstruction to ice movement, thereby enhancing the possibility of establishing fixed ice packs in the vicinity of heat pipe 18 near the surface of the water. This encapsulating effect could then propogate down the heat pipe, prevent periodic release of ice, and thus diminish the amount of ice which may be formed, (due to the lower thermal conductivity of ice, as discussed previously in the Background of the Invention).

In order to maximize transfer of heat to the ambient from heat pipe assembly 10, various external structures may be attached to the upper section of assembly 10. One of the most common heat exchange means to dissipate heat is a plurality of cooling fins 26 in good thermal contact with heat pipe 18. Another highly efficient means to dissipate heat, which will be discussed in detail in the context of FIG. 2, is by use of swaged metal sheet panels containing a network of channels, sold under the trademark "Roll-Bond". To carry out passive freezing and timely release of ice, the conventional heat pipe structure has been modified to include internal heat pipe 28, on timer reservoir 30, and off timer reservoir 32, as shown in FIG. 1.

In order to carry out passive ice formation and release as intended, it is necessary that a conventional thermal inversion exists in tank 14, i.e., the water at the surface of tank 14 should be near 0° C., and the water temperature should be approximately 4° C. near the bottom. This thermal inversion is a normal consequence of the maximum density of water occuring at 4° C. As water is cooled down by the heat pipe action, the water temperature passes through 4°; and water at 4° C. then accumulates at the bottom of tank 14 with ice 24 and water at 0° C. of lesser density segregating at the top of tank 14. Even if the tank did not naturally exhibit such a temperature inversion (perhaps due to the tank being very well insulated), a thermal short to ground 16 could be instilled, thereby creating the desired temperature inversion.

Assuming the conditions of thermal inversion just described and with heat pipe assembly 10 immersed in tank 14, as shown in FIG. 1, the cooling action begins by heat pipe fluid 20 undergoing boiling action in the bottom section of heat pipe 18. Heat pipe fluid vapor 34 travels upward in heat pipe 18, and then vapor condenses on the cold surfaces interior to the portion of heat pipe 18 above ground. Condensation occurs not only on the inner walls of heat pipe 18 above ground but also on fluid proportioner 36, which collects some of the condensed fluid 20. This condensation process releases heat to the cold ambient primarily through cooling fins 26. An example of an effective fluid proportioner means is the inverted tree-like fluid proportioner 36 depicted in FIG. 1. Proportioner 36 is shown with a central stem 38 and a plurality of radiating branches 40. Fluid condenses on branches 40, drains onto the central stem 38, and then down into on-timer reservoir 30. Another conceivable fluid proportioner design is a longitudinal cross section of a funnel with the funnel affixed to the inside wall of heat pipe 18, thereby collecting fluid and draining the fluid into on-timer reservoir 30.

Upon condensation of vapors 34, the condensed heat pipe fluid returns by gravity either to the lower section of heat pipe 18, the on-timer reservoir 30, or into off-time reservoir 32. Eventually, the lower evaporator section of heat pipe 18 runs dry and heat pipe cooling action is terminated. At this stage of the cooling cycle, heat pipe 18 is in the defrost or ice melting mode with fluid 20 retained both within off-timer reservoir 32 and on-timer reservoir 30. Also, at this stage, reservoir 30 is not completely full. This is by design in order that internal heat pipe 28 may be utilized to: (1) melt the ice frozen on heat pipe 18 between fins 22, and (2) complete the filling of on-timer reservoir 30.

The effective release of ice during the defrost part of the cycle is accomplished by transfer of heat from the warmer 4° C. water at the bottom of heat pipe 18 through the heat pipe wall, and into internal heat pipe fluid 42 held within internal heat pipe 28. The geometry of internal heat pipe 28 may for example by cylindrical or annular in order to fit the other design constraints. The heat collected from water in tank 14 is then transferred by vaporizing fluid 42, the vapor rising to the upper closed end of internal heat pipe 28. This heat is then transferred through the heat pipe walls to warm the ice formed on the exterior of heat pipe 18 and between fins 22. This warming action causes release of ice 24 and also leads to boil off of fluid 20 held in off-timer reservoir 32. The fluid boiled away from reservoir 32 condenses on fluid proportioner 36, and accumulates in on-timer reservoir 30. When off-timer reservoir 32 is boiled dry by the action of internal heat pipe 28, the melting mode is completed. At the same time, sufficient fluid has accumulated in on-timer reservoir 30, such that siphon 44 in reservoir 30 operates to dump the fluid contained in reservoir 30 back into the lower evaporator section of heat pipe 18.

A more simplified geometry for insuring reliable filling of off-timer reservoir 32 would be to position siphon 44 to dump into off-timer reservoir 32 rather than into the lower evaporator section of heat pipe 18. This would result in filling of reservoir 32 and the majority of fluid 20 overflowing into the lower section of heat pipe 18. This design would also not require such a high precision geometry for collection of a predictable amount of condensed fluid. Assembly 10 is also designed to allow some small fraction of fluid to be within off-timer reservoir 32 at the time on-timer reservoir 30 is full. This small excess amount of fluid permits some additional freedom in design of the system so that great precision is not required in adjusting the system variables in order to have an effective device.

The length of each phase of the cooling cycle may be adjusted by alteration of some of the more important variables of the invention: the total quantity of fluid 20, the relative volumes contained within off-timer reservoir 32 and on-timer reservoir 30, the efficiency of the fluid proportioner 36, and the heating capability of internal heat pipe 28. The general effect of changing each of those variables with all others fixed is as follows: (1) as the quantity of fluid 20 is increased, the time between cycles increases, (2) as the volume of off-timer reservoir 32 increases relative to the on timer reservoir 30, the defrost time increases, (3) as the efficiency of fluid proportioner 36 decreases, the time increases between defrost periods and (4) as the heating capability of internal heat pipe 28 increases, the length of the defrost period decreases.

Figure 3:
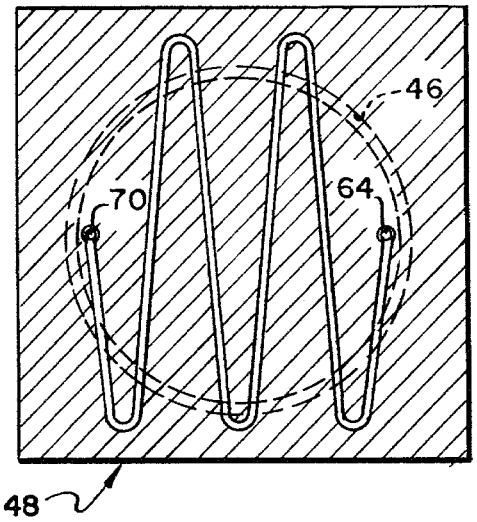
FIG. 3 shows a view through cross section 3 of FIG. 2.
Figure 4:
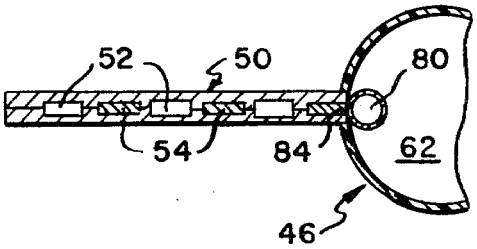
FIG. 4 shows a view through cross section 4 of FIG. 2.

An alternative embodiment is shown in FIGS. 2 through 4. In this arrangement, the main distinction from the device shown in FIG. 1 is the use of swaged metal sheet assemblies (sold as "Roll-Bond"), in place of freezing fins 22 and cooling fins 26 in FIG. 1. These metal sheet assemblies comprise two metal sheets swaged together, and between the sheets are sandwiched open channel networks. This type of metal sheet assembly has proven to be effective as a heat exchange structure for implementation of the subject invention.

FIGS. 2–4 illustrate the use of the metal sheet assembly design in two parts of heat pipe device 46: a condensation metal sheet assembly 48 and a freezing metal sheet assembly 50. During operation, heat pipe device 46 may be used individually or grouped in clusters or even installed within a common container before placement in a tank for freezing of ice. Freezing assembly 50 contains channeled heat pipe 52 and channeled internal heat pipe 54 which contains channeled internal heat pipe fluid 55. FIG. 4 illustrates assembly 50 in cross section. Upon comparison to FIG. 1, the components of assembly 50 carry out the same cooling functions in a similar fashion as heat pipe 18 of in FIG. 1, with channeled heat pipe fluid 56 in channeled heat pipe 52 absorbing heat from the water in which assembly 50 is immersed.

If we begin the cooling cycle by assuming all of fluid 56 is in channeled heat pipe 52, absorption of the heat by assembly 50 causes fluid 56 to boil off. Boil off vapors 58 then pass out of freezing assembly 50, through output section 60 and into lower chamber 62 of heat pipe device 46. These vapors 58, which contain the heat absorbed from the water, are funneled into collection pipe 64 by placement of vapor barrier 66 with inverted funnel device 68 leading to collection pipe 64. This collection pipe 64 is positioned well above the opening from drain pipe 70, thereby insuring transport of boil-off vapors 58 into collection pipe 64, not drain pipe 70. Boil off vapors 58 enter condensation assembly 48 near the top, vapors 58 are condensed into liquid and the action of gravity causes fluid to empty into drain pipe 70. The fluid then flows down drain pipe 70 into second on-timer reservoir 74. By use of condensation assembly 48, collection pipe 64, and drain pipe 70, the fluid proportioning or collection efficiency may approach near 100%.

In order to avoid any substantial condensation of boil-off vapor 58 within collection pipe 64 and consequent loss of fluid 56 through drainage from collection pipe 64 into lower chamber 62, it is important that collection pipe 64 be insulated from ambient temperatures. Thus, we utilize polyurethane foam insulation 72 in the upper part of heat pipe device 46. As a precaution against loss of fluid through drainage back down collection pipe 64, a drip funnel 75 may be positioned below inverted funnel 68. Funnel 75 is located so as not to obstruct flow of vapors 58 into collection pipe 64. Drip funnel 75 would then be attached to reservoir 74 and empty any collected fluid into reservoir 74.

When fluid level 76 in reservoir 74 reaches the top of second siphon 78, the fluid is dumped back into freezing metal sheet assembly 50, with some residual fluid retained within second off-timer reservoir 80. Note that section 79 of heat pipe 52 is angled downward slightly to ensure effective drainage of fluid 56 back into the lower section of pipe 52. Just before the fluid is dumped from reservoir 74, freezing action by device 46 is still occurring. Furthermore, after this first dumping of fluid from reservoir 74, cooling action continues via channeled heat pipe 52, wherein vapors are boiled away, vapors are passed through pipe 64 into condenser assembly 48, and fluid is drained through drain pipe 70 into reservoir 74. At this stage of the cycle, fluid 56 is now accumulated not only in on-timer reservoir 74 (as it was in first half of the freezing cycle) but also within off-timer reservoir 80. It is now possible for channeled heat pipe 52 to run dry, and the defrost portion of the cycle may commence.

In this defrost portion of the cycle, the warming action of internal heat pipe 54 transports heat from the 4° C. water near the bottom of device 46 to the top of assembly 50, where the surrounding water is near 0° C. This heat transfer warms ice attached to assembly 50 and also causes boiling of fluid in off-timer reservoir 80. The warm-up of reservoir 80 is accomplished primarily by portion 82 of channeled internal heat pipe 54 being in close thermal communication with reservoir 80 by soldering or welding reservoir 80 to dividing wall 84 separating portion 82 and reservoir 80. The vapors from reservoir 80 which boil off due to this warming action are condensed in assembly 48. Liquid is then passed down drain pipe 70 into on-timer reservoir 74, which was partially filled. Eventually, reservoir 74 fills up and dumps fluid back into channeled heat pipe 52 and off timer reservoir 80. The freezing action of heat pipe device 46 then commences again which marks the beginning of the entire cycle.

The embodiment of the invention in which an exclusive property or privilege is claimed are defined as follows:

1. A passive ice freezing-release heat pipe assembly comprising a diode heat pipe, a fluid disposed within said heat pipe, heat exchange means coupled to said heat pipe and capable of dissipating heat to the ambient during the freezing cycle of said heat pipe, a fluid proportioner means disposed within said heat pipe for collecting said fluid condensed from the vapor phase formed by said fluid absorbing heat and thereby boiling away during the freezing cycle, a passive on timer means disposed within said heat pipe and for accumulating fluid collected by said fluid proportioner means, a passive off-timer means disposed within said heat pipe and for collecting fluid condensed from the vapor phase and for holding the fluid until the end of the defrost part of the freezing cycle, and a means disposed within said heat pipe and capable of effectuating fluid transfer from said off-timer means to said on-timer means precedent to the defrost part of the freezing cycle.

2. The device of claim 1, wherein said fluid proportioner means is a central stem axially disposed within said heat pipe assembly with a plurality of branches radiating from said stem, said branches positioned to be able to drain working fluid after condensation onto said stem for collection by said on-timer means.

3. The device of claim 2, wherein said fluid proportioner means is an angular longitudinal segment of a cone disposed within said heat pipe assembly and capable of collecting working fluid after condensation for said on-timer means.

4. The device of claim 3, wherein said passive on-timer means is an on-timer reservoir capable of collecting working fluid taken from said fluid proportioner, said reservoir including a dumping means capable of dumping a pre-set level of working fluid.

5. The device of claim 4, wherein said fluid dumping means is a siphon.

6. The device of claim 5, wherein said passive off-timer means is an off-timer reservoir capable of collecting working fluid after condensation.

7. The device of claim 6, wherein the volume of said off-timer reservoir is less than the volume of said on-timer reservoir.

8. The device of claim 7, wherein said means capable of effectuating fluid transfer from said off-timer reservoir to said on-timer reservoir is a collaboration between an internal heat pipe in thermal communication with said off-timer reservoir and said fluid proportioner, which collects said fluid condensed from the vapor phase and delivers said fluid to said on-timer reservoir.

9. The device of claim 8, wherein said heat pipe assembly has a freezing assembly means attached externally to the portion of said heat pipe assembly immersed in the water, said freezing assembly means thermal communication with said internal heat pipe which is capable of transferring heat to said freezing assembly means, thereby assisting release of ice attached thereto.

10. The device of claim 9, wherein said freezing assembly means are cooling fins.

11. The device of claim 10, wherein said heat exchange means is a plurality of cooling fins.

12. The device of claim 1, wherein said heat exchange means is a condensation metal sheet assembly.

13. The device of claim 12, wherein said heat pipe assembly is a freezing metal sheet assembly.

14. The device of claim 13, wherein said freezing metal sheet assembly includes said off-timer reservoir, said heat pipe, and an internal heat pipe.

15. The device of claim 1, wherein said fluid proportioner means and said heat exchange means are combined and include a condensation metal sheet assembly, a boil-off vapor collection pipe, a drain pipe, and thermal insulation means between said collection pipe and the ambient.

* * * * *